US006021893A

United States Patent [19]

Boriani et al.

[11] Patent Number: 6,021,893

[45] Date of Patent: Feb. 8, 2000

[54] CARTON FOR PACKETS OF CIGARETTES

[75] Inventors: Silvano Boriani, Bologna; Alessandro Minarelli, Bazzano (Bologna), both of Italy

[73] Assignee: G.D. S.P.A., Bologna, Italy

[21] Appl. No.: 09/112,133

[22] Filed: Jul. 9, 1998

[30] Foreign Application Priority Data

Jul. 9, 1997 [IT] Italy ..... BO97A0420

[51] Int. Cl.[7] ..... B65D 85/10

[52] U.S. Cl. ..... 206/256; 206/273

[58] Field of Search ..... 206/242, 268, 206/271, 273, 275, 256; 229/160.1, 182.1, 103.2, 109, 190

[56] References Cited

U.S. PATENT DOCUMENTS

| | | | |
|---|---|---|---|
| 1,887,946 | 11/1932 | Sanders | 206/242 |
| 3,536,246 | 10/1970 | Rosen | 206/256 |
| 3,752,308 | 8/1973 | Begemann | 206/256 |
| 4,738,359 | 4/1988 | Phillips, Jr. | 206/256 |
| 4,753,384 | 6/1988 | Focke et al. | 229/160.1 |
| 4,779,723 | 10/1988 | Focke et al. | 206/273 |
| 5,143,282 | 9/1992 | Pham | 229/160.1 |
| 5,529,180 | 6/1996 | Paolucci et al. | 206/268 |

FOREIGN PATENT DOCUMENTS

| | | |
|---|---|---|
| 712784A2 | 7/1991 | European Pat. Off. . |
| 638482A1 | 7/1994 | European Pat. Off. . |
| 4341129A1 | 6/1995 | Germany . |

*Primary Examiner*—Bryon P. Gehman
*Assistant Examiner*—Luan K. Bui
*Attorney, Agent, or Firm*—Pillsbury Madison & Sutro

[57] ABSTRACT

Finished packets of cigarettes are wrapped in a parallelepiped carton of substantially squat appearance, disposed one alongside and in contact with another in such a way as to make up at least one row extending along a longitudinal reference line parallel with the predominating dimension of the carton; the erected carton has four longitudinal sides including two larger longitudinal side faces, two smaller longitudinal side faces and two transverse sides constituting respective end faces, and presents at least one longitudinal fillet extending parallel with the longitudinal reference line, by which at least two contiguous longitudinal side faces are interconnected.

12 Claims, 4 Drawing Sheets

CARTON FOR PACKETS OF CIGARETTES

BACKGROUND OF THE INVENTION

The present invention relates to a carton for packets of cigarettes.

The term "carton" is employed in this context to describe a rigid container, appearing typically as a rectangular parallelepiped with sharply defined corner edges and designed to hold several packets of cigarettes. Conventionally, such cartons are fashioned from flat diecut blanks of substantially rectangular geometry; the single blank presents a plurality of longitudinal crease lines that serve to define an intermediate longitudinal portion creating a first smaller flank face of the carton, also two longitudinal portions lying one on either side of the intermediate portion and affording two panels, each creating a larger face of the carton and connected to the intermediate portion along a respective longitudinal crease line.

The single panels are associated on the one hand with the intermediate portion and on the other with one of two longitudinal flaps connected each to the respective panel along a relative crease line and combining to form a closure.

Each longitudinal end of the blank exhibits two projecting end folds connected each to a relative panel by way of a transverse crease line, and an end flap connected to the intermediate portion likewise by way of a respective transverse crease line.

To erect the individual carton, the two panels are bent convergently through right angles along the respective longitudinal crease lines relative to the intermediate longitudinal portion, and the two longitudinal flaps of the closure bent similarly through right angles along the respective crease lines relative to the associated panels in such a way as to create a second smaller flank face.

With the blank thus formed initially into a tubular container, the end faces are completed by bending the sets of end folds through a right angle in relation to the panels along the connecting crease lines, and the end flaps similarly in relation to the intermediate portion, in such a manner that the two folds and the flap at each end are brought into a common plane and can be sealed together to secure the carton.

It has been observed that the amount of additional paperboard material needed per single blank in order to maintain well defined corners on a carton is disadvantageously wasteful, and in view of the considerable number of cartons turned out during a normal production run, it will be clear enough that the waste of material is significant and the costs of manufacture increased as a result.

The object of the present invention is to provide a carton for packets of cigarettes needing a quantity of material for its manufacture less than would be needed for a conventional parallelepiped carton of equivalent proportions.

A further object of the invention is to provide a carton for packets of cigarettes that exhibits a distinct visual superiority over the conventional parallelepiped carton.

SUMMARY OF THE INVENTION

The stated objects are realized in a carton for packets of cigarettes according to the present invention, internally of which the single packets are disposed alongside and in contact with one another so as to form at least one row extending along a predetermined longitudinal reference line. Such a carton typically presents a substantially squat parallelepiped shape with a predominating dimension parallel to the longitudinal reference line, and has four longitudinal sides comprising two larger longitudinal sides providing a top face and a bottom face, two smaller longitudinal sides providing a front face and a rear face, and two transverse sides as respective end faces; the two larger side faces, the two smaller side faces and the two end faces are disposed respectively in mutual opposition, and the carton also comprises at least one longitudinal fillet extending parallel with the longitudinal reference line, by which at least two contiguous longitudinal side faces of the four are interconnected.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
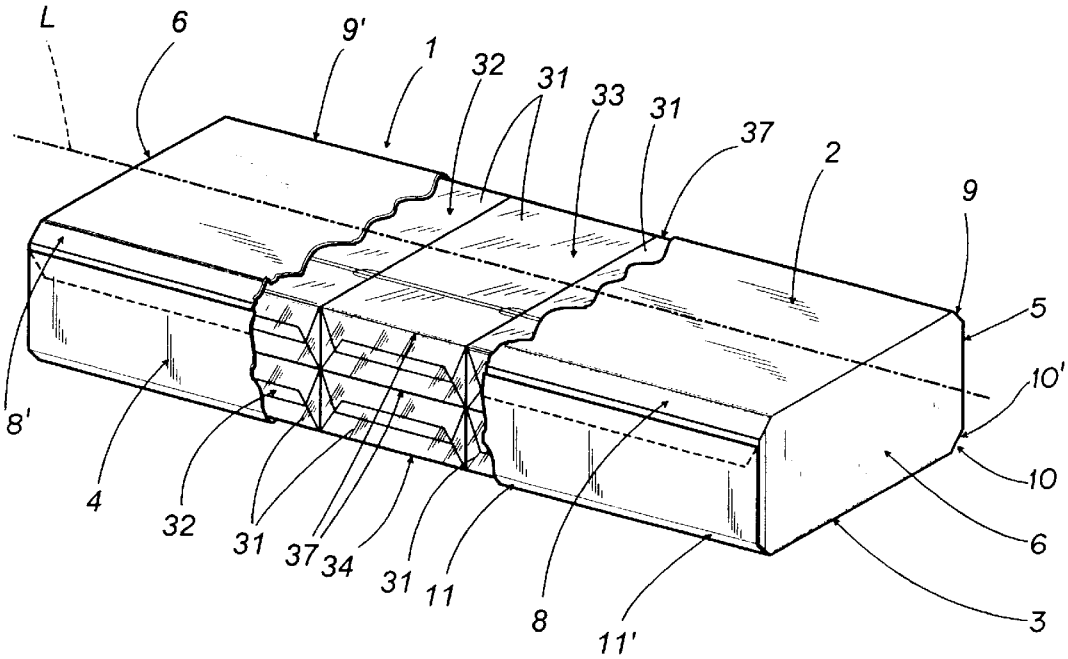
FIG. 1 illustrates a first preferred embodiment of the carton according to the present invention, seen in perspective.

With reference to FIG. 1 of the drawings, 1 denotes a carton accommodating packets 31 of cigarettes arranged alongside and in contact with one another, ordered in two stacked rows 32 and aligned along a given longitudinal reference line L. The carton 1 exhibits a substantially parallelepiped shape of which the predominating dimension coincides with the longitudinal reference line L. and appears relatively squat when considering its longitudinal proportions.

Observing FIGS. 1, 3, 5 and 6, the single packet 31 is substantially parallelepiped in shape, with a front face 33, a rear face 34, two flank faces 35 and two end faces 36, of which the front and rear faces 33 and 34 are joined to the two end faces 36 by way of respective corner edges 37. The packets 31 of each row 32 are positioned side by side with the corresponding flank faces 35 offered one to the next, whilst the front faces 33 of the packets 31 making up the bottom row 32 are breasted in contact with the rear faces 34 of the packets 31 making up the top row 32.

The carton 1 as illustrated in FIG. 1 exhibits four longitudinal sides comprising two mutually opposed and parallel larger side faces, denoted 2 and 3, and two mutually opposed and parallel smaller side faces 4 and 5, also two transverse end faces 6 disposed perpendicular to the longitudinal faces 2, 3, 4 and 5, likewise mutually opposed and parallel.

As discernible from FIG. 1, the larger longitudinal face 2 uppermost coincides with the top of the carton 1, the larger longitudinal face 3 opposite with the bottom, the smaller longitudinal face 4 forwardmost with the front flank and the opposite smaller longitudinal face 5 with the rear flank, whilst the two remaining faces 6 provide the ends.

A carton 1 according to the invention also exhibits four longitudinal connecting elements 8, 9, 10 and 11 extending parallel to the longitudinal reference line L, each positioned so as to interconnect two respective contiguously disposed faces 4 and 2, 2 and 5, 5 and 3, 3 and 4, The four elements 8, 9, 10 and 11 in question are disposed perpendicular to the two end faces 6 and appear as respective flat longitudinal fillets 8', 9', 10' and 11', each angled at 45° to the two relative interconnected contiguous faces.

Figure 2:
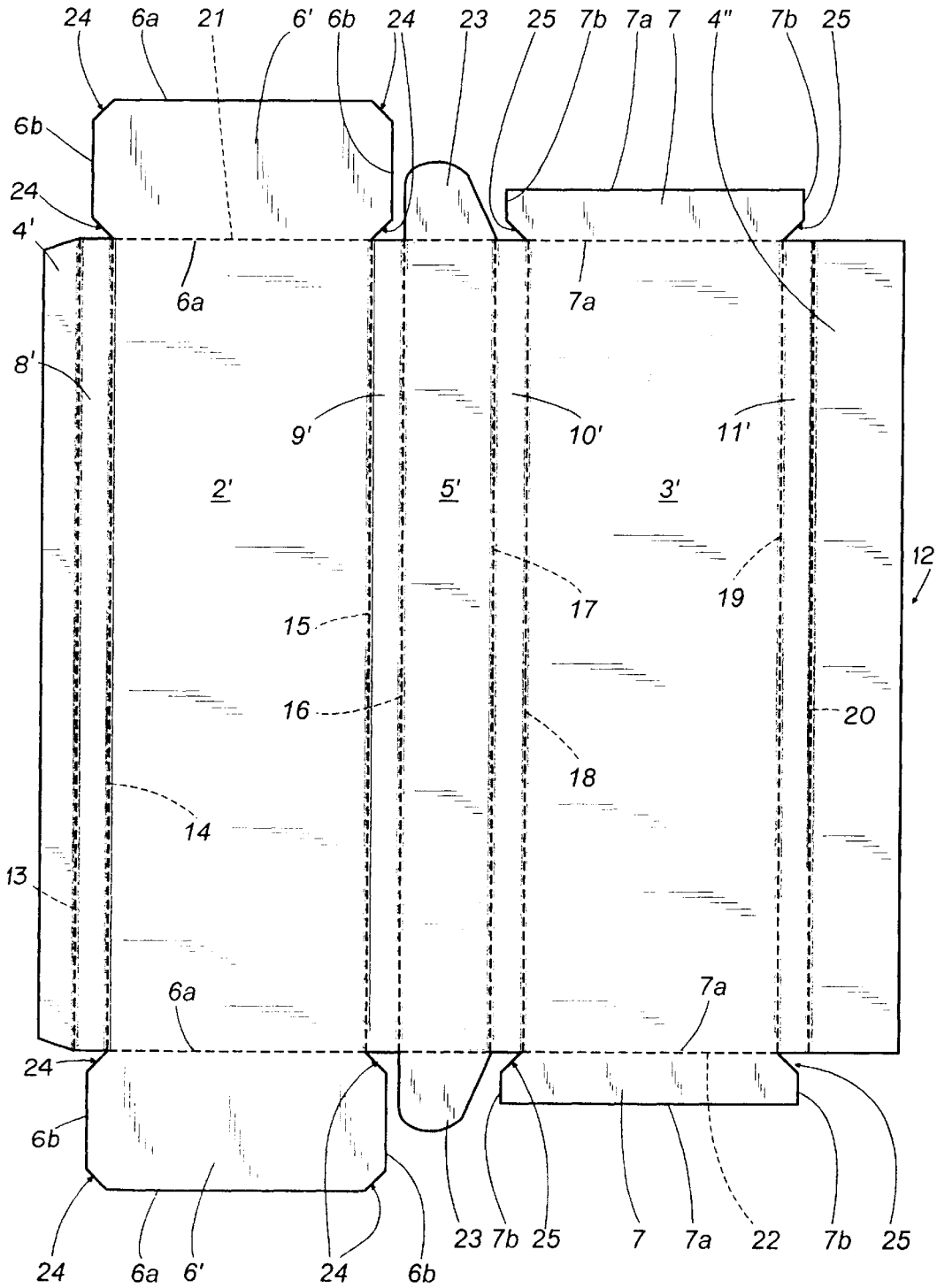
FIG. 2 is the plan view of a diecut blank as used to fashion the carton of FIG. 1.

Referring now to FIG. 2, the carton 1 is fashioned, by way of example, from a flat diecut blank 12 of which the component parts are indicated wherever possible with primed numbers matching the numbers utilized to denote the corresponding parts of the carton 1.

The blank 12 presents a substantially rectangular shape much the same as that of a blank from which a typical carton for packets of cigarettes would be fashioned, and exhibits a plurality of longitudinal crease lines denoted 13 to 20, also two transverse crease lines denoted 21 and 22.

The longitudinal crease lines 13 . . . 20 are arranged in such a way as to divide up the blank into a first longitudinal flap 4' bordered by the crease line denoted 13, a first panel 2' extending between the lines denoted 14 and 15, an intermediate portion 5' extending between the lines denoted 16 and 17, a second panel 3' between the lines denoted 18 and 19, and a second longitudinal flap 4" bordered by the crease line denoted 20, all of which compassed longitudinally between the two transverse crease lines 21 and 22. The first flap 4' is connected to the first panel 2' by way of the first fillet 8', which extends between the crease lines denoted 13 and 14; the intermediate portion 5' is connected on the one side (the left, as viewed in FIG. 2) to the first panel 2' by way of the second fillet 9' which extends between the lines denoted 15 and 16, and on the other side (the right, as viewed in FIG. 2) to the second panel 3' by way of the third fillet 10', which extends between the lines denoted 17 and 18; and lastly, the second flap 4" is connected to the second panel 3' by way of the fourth fillet 11', which extends between the lines denoted 19 and 20. The four fillets 8', 9', 10' and 11' all present a minimal transverse dimension and are identical one to another.

Each transverse crease line 21 and 22 marks a point at which the first panel 2' and the second panel 3' are joined with respective first end folds 6' and respective second end folds 7, and the intermediate portion 5' with respective end flaps 23.

To erect the carton 1, the first panel 2' and the second panel 3' are bent toward one another through a right angle relative each to the intermediate portion 5', whereupon the flaps 4' and 4" are bent at right angles relative to the panels 2' and 3' and overlapped to establish the forwardmost smaller longitudinal face 4 aforementioned; thus, the first and second panels 2' and 3' respectively become the top and bottom larger longitudinal faces 2 and 3, and the intermediate portion 5' becomes the smaller longitudinal face 5.

Similarly, the first and second end folds 6' and 7 are bent at right angles to the corresponding first and second panels 2' and 3' and the end flaps 23 at right angles to the intermediate portion 5'; once the two panels 2' and 3' have been positioned at right angles to the intermediate portion 5', the end folds 6' and 7 and flaps 23 can be overlapped one with another to establish the end faces 6 of the carton 1.

Still observing FIG. 2, it will be seen that each of the first end folds 6' is compassed peripherally by two mutually opposed transverse edges **6*a* of which one, and more exactly the edge adjoining the first panel 2', coincides with a respective transverse crease line 21 and 22, and by two mutually opposed longitudinal edges 6*b*. Similarly, each second end flap 7 is compassed peripherally by two mutually opposed transverse edges 7*a* of which one, that is, the edge adjoining the second panel 3', coincides with a respective transverse crease line 21 and 22, and by two mutually opposed longitudinal edges 7*b*. The two longitudinal edges 6*b* and 7*b* are referred to as such by reason of their coinciding with the predominant longitudinal dimension of the diecut blank 12**.

According to the present invention, each first end fold 6' exhibits at least one first portion 24 adjacent to one of the transverse edges **6*a*, by way of which the selfsame transverse edge 6*a* and an adjoining longitudinal edge 6*b* are united. Likewise each second end fold 7 also exhibits at least one first portion 25 adjacent to the transverse edge 7*a* coinciding with the relative crease line 21 and 22, by which the transverse edge 7*a* and an adjoining longitudinal edge 7*b*** are united.

The two respective first connecting portions 24 and 25 are located at corresponding extremities of the respective transverse edges **6*a* and 7*a*, in such a way as to coincide exactly when the panels 2' and 3' are bent at right angles and the end folds 6' and 7** brought into overlapping contact.

In the example of FIG. 2, each first end fold 6' exhibits four connecting portions 24 located at the four respective corners, disposed at 45° to the reference line L and compassed respectively between the crease lines denoted 13 and 14 and between the crease lines denoted 15 and 16, of which the two portions 24 adjacent to the transverse edge Ca of the end fold 6' that coincides with the relative transverse crease line 21 and 22 will be seen to connect the periphery of the end fold 6' with that of the first panel 2'.

In the same way, each second end fold 7 exhibits at least two connecting portions 25 located at the two corners adjacent to the transverse edge **7*a* shared with the second panel 3', which lie adjacent to the relative transverse crease line 21 and 22 and are compassed respectively between the longitudinal crease lines denoted 17 and 18 and the longitudinal crease lines denoted 19 and 20**.

The width of the individual first and second end folds 6' and 7, measured along a direction parallel to the transverse crease lines 21 and 22, is less than the overall width of the first panel 2' plus the two corresponding fillets 8' and 9' and of the second panel 3' plus the two corresponding fillets 10' and 11', respectively; similarly, the height of the first end folds 6', measured along a direction parallel to the longitudinal crease lines 13 . . . 20, is less than the overall width of the intermediate portion 5' plus the two respective fillets 9' and 10', so that on completion of the various bending and overlapping steps already mentioned, the pairs of connecting portions 24 and 25 will coincide and establish shaped edges around each of the two end faces 6 of the carton 1. Likewise on completion of the bending operations, the fillets 8', 9', 10, and 11' will be positioned with their endmost edges, coinciding with the two transverse crease lines 21 and 22, resting upon and covering the corresponding angled portions 24 and 25.

In the erected carton 1, the portions 24 located adjacent to the transverse edge **6*a* of each first end fold 6' adjoining the first panel 2', hence adjacent to the relative transverse crease line 21 and 22, are associated although not connected with the corresponding endmost edges of the respective fillets 8' and 9', signifying ultimately that the selfsame endmost edges of the fillets 8' and 9', will interact with but remain detached from the matching shaped edges of the finished end face 6. In like manner, the portions 25 located adjacent to the transverse edge 7*a* of each second end fold 7 adjoining the second panel 3', hence also to the transverse crease line 21 and 22, are associated though not connected with the corresponding endmost edges of the two respective fillets 10' and 11', signifying ultimately that the selfsame endmost edges of the fillets 10' and 11' will interact with but remain detached from the matching shaped edges of the finished end face 6**.

Thanks to the inclusion of the interconnecting fillets 8', 9', 10' and 11', the overall width of the diecut blank 12 is less than that presented by a conventional blank as used to fashion a similar parallelepiped carton with sharply defined corners.

Figure 3:
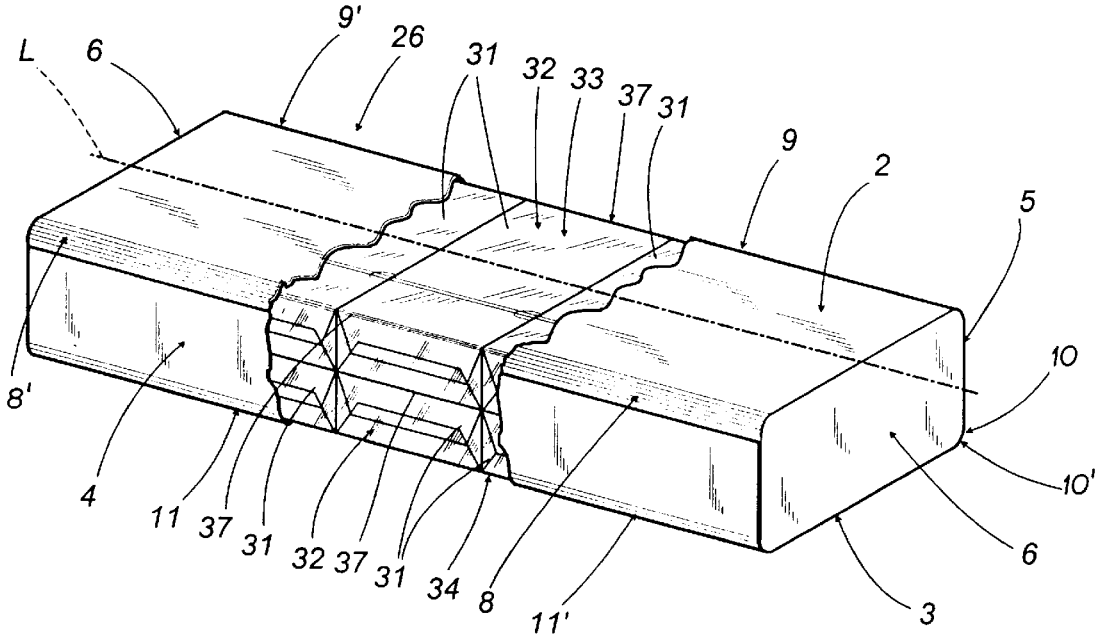
FIG. 3 illustrates a second preferred embodiment of the carton according to the present invention, seen in perspective.
Figure 4:
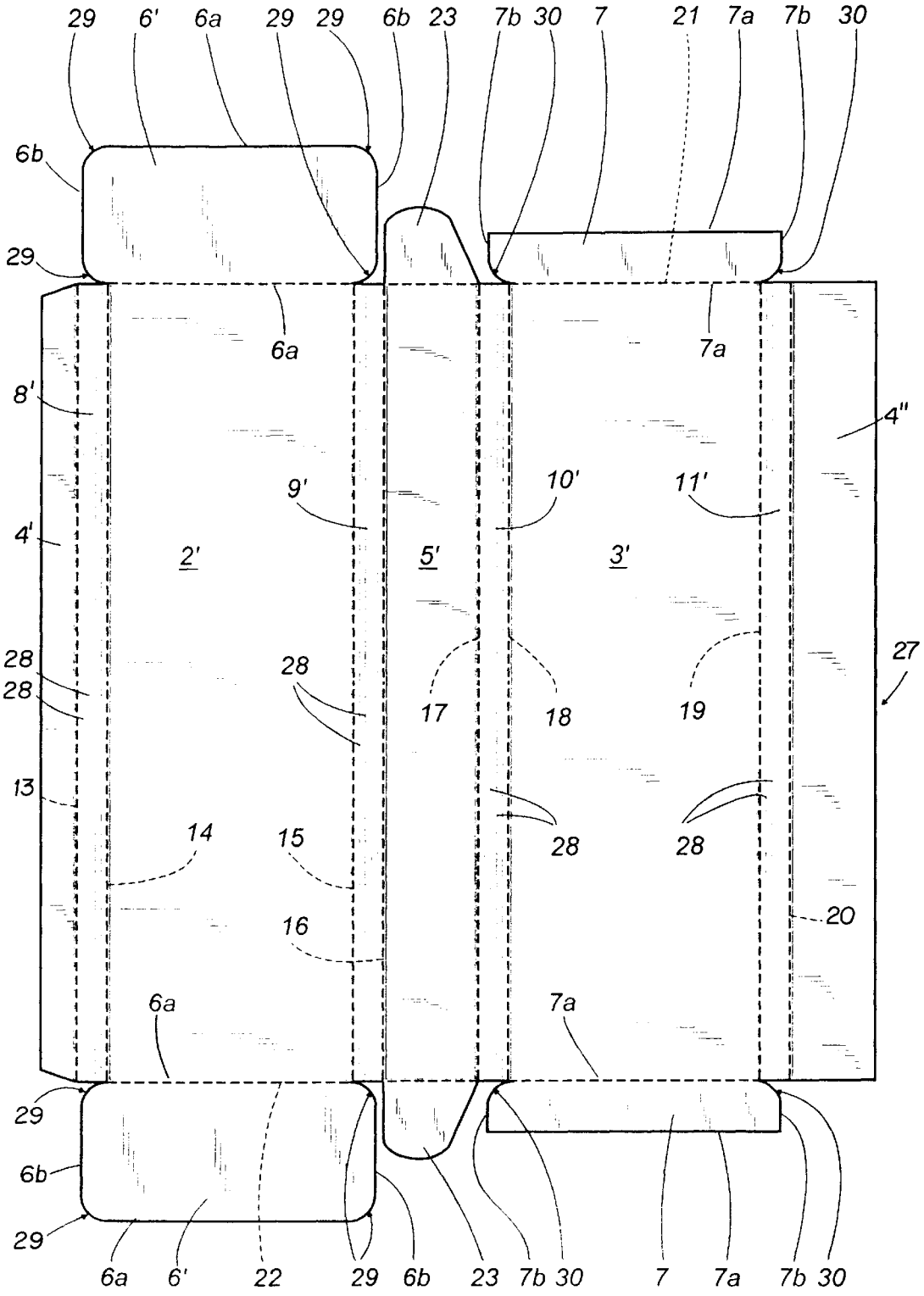
FIG. 4 is the plan view of a diecut blank as used to fashion the carton of FIG. 3.

FIG. 3 illustrates a carton 26 essentially similar to the carton 1 in FIG. 1. of which the component parts are indicated, wherever possible, utilizing the same reference numbers. In this carton 26, the connecting elements 8, 9, 10 and 11 are generated by fillets 8', 9', 10' and 11' such as will produce blunted longitudinal edges presenting a curved profile in section; consequently, the carton 26 is erected using a diecut blank 27 as illustrated in FIG. 4, which differs from the blank 12 of FIG. 2, firstly, in that each of the single fillets 8', 9', 10' and 11' presents a plurality of longitudinal crease lines 28, and secondly in that the first end folds 6' and the second end folds 7 are embodied with respective connecting portions 29 and 30 of circular or rounded profile.

Figure 5:
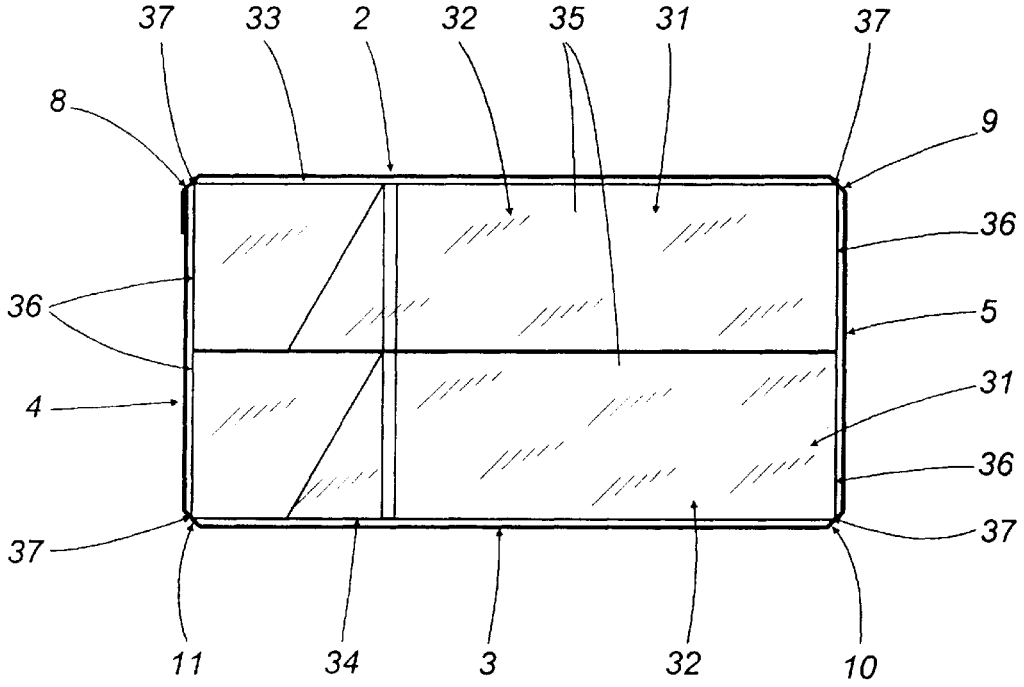
FIG. 5 is the cross sectional view of a carton as in FIG. 1.
Figure 6:
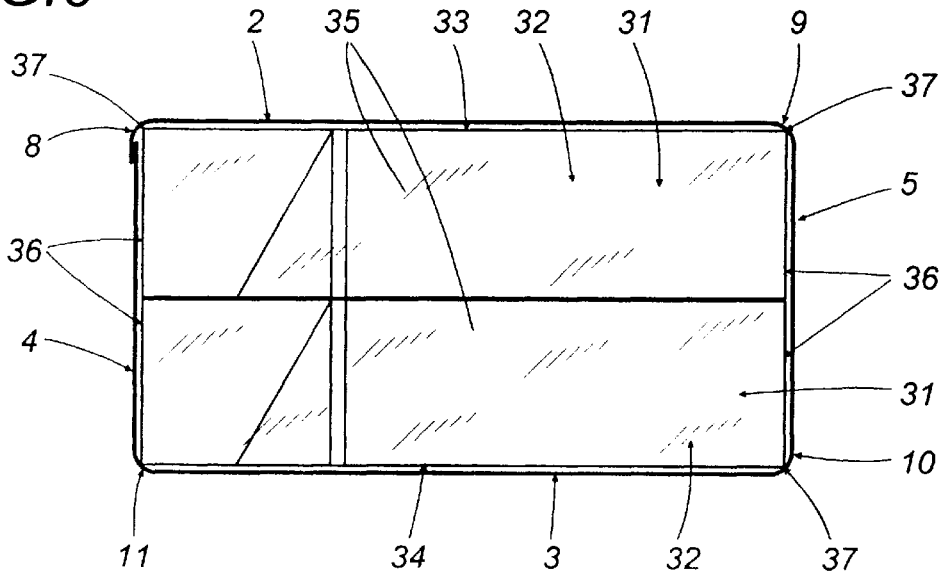
FIG. 6 is the cross sectional view of a carton as in FIG. 3.

Once wrapped in the finished carton, as shown in FIGS. 5 and 6, the only points of contact between the packets 31 and the carton 1 or 26 will be at the meeting of the corner edges 37 and the inside surfaces of the respective longitudinal elements 8, 9, 10 and 11 by which the contiguously disposed longitudinal side faces 4 and 2, 2 and 5, 5 and 3, 3 and 4 of the carton are interconnected.

Accordingly, there is no contact between the top longitudinal face 2 of the carton 1 or 26 and the front faces 33 of the packets 31 making up the top row 32, as likewise there is no contact between the bottom longitudinal face 3 of the carton 1 or 26 and the rear faces 34 of the packets 31 making up the bottom row 32. Similarly, there is no contact between the two longitudinal smaller side faces 4 and 5 of the carton 1 or 26 and the end faces 36 of the packets 31.

Packets 31 wrapped in a carton 1 or 26 according to the invention are thus supported along the full length of the two rows 32 principally by the four longitudinal fillets 8', 9', 10' and 11' located in contact with the corner edges 37 of the individual packets 31. In this way, a limited "clearance" is created between the packets 31 and the longitudinal side faces 2, 3, 4 and 5 of the carton 1 or 26, which has the effect of making the packets easy to remove, and more especially, of cushioning against accidental external forces that may impact on the carton, inasmuch as a slight elastic and therefore temporary deformation of the side faces 2, 3, 4 and 5 will prevent a permanent, plastic deformation of the packets 31.

The carton 1 or 26, according to the present invention but not illustrated, can also accommodate a plurality of packets 31 being arranged with their respective longitudinal axis parallel to said given longitudinal reference line L and forming at least one stacked row 32 in such a manner that at least one longitudinal corner edge of each packet 31 is disposed in contact with the inside surface of the at least one longitudinal element 8, 9, 10 and 11, wherein said longitudinal corner edge is defined by the front face 33, or the rear face 34, and the relative flank face 35, joined together, respectively.

Accordingly, the packets 31 can be arranged in the carton 1 or 26 such that the second transversal corner edges, which are defined by the flank faces 35 and the end faces 36, are disposed in contact with at least one longitudinal element 8, 9, 10 and 11.

Therefore, said longitudinal or second transversal corner edge of each packet 31 has the same supporting function as the above-mentioned corner edge 37 of the first and second preferred embodiment of the carton 1 or 26.

Said longitudinal or transversal corner edges can also have a form (not illustrated) corresponding to the shape of the longitudinal elements 8, 9, 10 and 11, but leaving always a limited "clearance" between the packet 31 and the longitudinal side faces 2, 3, 4, and 5 of the carton 1 or 26.

What is claimed:

1. A carton dimensioned for holding a plurality of packets of cigarettes, each of the packets having a plurality of faces and corner edges, each corner edge joining two of the faces and the packets being disposed within the carton beside and in contact with one another so as to form at least one row extending along a predetermined longitudinal reference line, wherein the carton presents a substantially squat parallelepiped shape of which the predominating dimension extends parallel with the longitudinal reference line, and is fashioned with four longitudinal sides comprising two larger longitudinal sides respectively constituting a top face and a bottom face, two smaller longitudinal sides respectively constituting a front face and a rear face, and two transverse sides constituting respective end faces, of which the two larger side faces, the two smaller side faces and the two end faces are disposed respectively in mutual opposition, also with at least one longitudinal connecting element extending parallel to the longitudinal reference line, by which at least two contiguous longitudinal side faces of the four are interconnected, and further wherein said at least one longitudinal connecting element is configured to support a corner edge of each of a plurality of the packets to establish a clearance between the longitudinal sides of the carton and faces of the packets that face the longitudinal sides.

2. A carton as in claim 1, wherein the longitudinal connecting element consists in a flat longitudinal fillet angled obliquely relative to two contiguous faces of the carton in such a way as to create at least one blunted longitudinal corner edge of flat profile.

3. A carton as in claim 2, wherein the obliquely angled flat longitudinal fillet is disposed at 45° in relation to two contiguous faces of the carton.

4. A carton as in claim 1, wherein the longitudinal connecting element consists in a longitudinal fillet of curved section interconnecting two contiguous faces of the carton in such a way as to create at least one blunted longitudinal corner edge of rounded profile.

5. A carton as in claim 2, wherein the longitudinal fillet exhibits two respective opposite endmost edges offered to but detached from matching shaped edges of the finished end face of the carton.

6. A carton as in claim 1, erected from a flat, substantially rectangular diecut blank exhibiting two transverse crease lines and a plurality of longitudinal crease lines arranged in such a way as to divide up the area of the blank lying between the two transverse crease lines into an intermediate portion, a first and a second panel disposed one on either side of the intermediate portion, also a first and a second longitudinal flap joined respectively to the first and to the second panel by relative crease lines, of which the first panel is extended at the two longitudinal extremities to form two first opposite end folds, the second panel is extended at the two longitudinal extremities to form two second opposite end folds, and the intermediate portion is extended at the two longitudinal extremities to form two opposite end flaps, in such a manner that each first end fold coincides positionally and combines with the corresponding second end fold and the relative end flap, interposed between the first and second end folds, to establish a respective transverse end face of the carton, wherein each first and second end fold is compassed peripherally by two mutually opposed transverse edges and two mutually opposed longitudinal edges and exhibits at least one first portion located at one transverse extremity of a respective transverse edge, connecting the selfsame transverse edge with the adjoining longitudinal edge and, when the carton is erected, combining with the corresponding first portion connecting a transverse edge and a longitudinal edge of the second and first end fold to establish the plane occupied by the longitudinal connecting element.

7. A carton as in claim 6, wherein each first and second end fold exhibits a first and a second portion located at the two transverse extremities of a transverse edge, connecting the relative transverse edge with the adjoining longitudinal edges and, when the carton is erected, combining with corresponding first and second portions connecting a transverse edge and the longitudinal edges of the second and first end fold to establish the planes occupied by two longitudinal connecting elements.

8. A carton as in claim 7, wherein the first end folds exhibit first, second, third and fourth portions connecting the transverse edges and the adjoining longitudinal edges.

9. A carton as in claim 8, wherein each of the first, second, third and fourth portions appears as a straight line extending obliquely between a transverse edge and an adjoining longitudinal edge.

10. A carton as in claims 8, wherein each of the first, second, third and fourth portions appears as a curved line interconnecting a transverse edge and an adjoining longitudinal edge.

11. A carton as in claims 1, containing single packets of substantially parallelepiped shape exhibiting a front face, a rear face, two flank faces and two end faces, wherein two faces of said faces are joined together by way of a respective corner edge, and wherein the contents of the carton consist in a plurality of such packets ordered beside and in contact with one another so as to form at least one row extending along a predetermined longitudinal reference line, and disposed in contact by way of at least one said respective corner edge with the inside surface of the at least one longitudinal element by which two contiguously disposed longitudinal side faces of the carton are interconnected.

12. A carton as in claims 1, containing single packets of substantially parallelepiped shape exhibiting a front face, a rear face, two flank faces and two end faces, wherein two faces of said faces are joined together by way of a respective corner edge, and wherein said carton is provided with four longitudinal elements interconnecting the four contiguously disposed longitudinal side faces, and wherein the contents of the carton consist in a plurality of such packets ordered beside and in contact with one another so as to form at least one row extending along a predetermined longitudinal reference line, and disposed in contact with the carton solely at points where at least one said respective corner edge meets the inside surfaces of the corresponding longitudinal elements by which the respective contiguously disposed side faces of the carton are interconnected.

* * * * *